United States Patent [19]

Wuebker et al.

[11] Patent Number: 4,824,056

[45] Date of Patent: Apr. 25, 1989

[54] SUSPENSION SYSTEM HANGER MEANS FORMED BY COLD FORMING PROCESSES

[75] Inventors: Robert A. Wuebker, Westerville; Ova A. Helton, Columbus; Albert R. Roggeman, Stryker; Thomas P. Switzer, Baltimore, all of Ohio

[73] Assignee: General Signal Corporation, New York, N.Y.

[21] Appl. No.: 383,601

[22] Filed: Jun. 1, 1982

[51] Int. Cl.[4] ..... F16L 3/00

[52] U.S. Cl. ..... 248/60; 248/610

[58] Field of Search ..... 248/60, 58, 62, 610, 248/581, 312.1; 403/247, 256; 180/309; 74/594.4, 594.1

[56] References Cited

U.S. PATENT DOCUMENTS

| | | | |
|---|---|---|---|
| 1,354,811 | 10/1920 | Faistenhammer . | |
| 2,246,457 | 6/1941 | Schultz | 248/220.3 |
| 2,744,706 | 5/1956 | Gerdy | 248/60 |
| 2,899,842 | 8/1959 | Krokos et al. | 74/594.4 |
| 2,911,460 | 11/1959 | Oxley | 403/247 |
| 3,014,681 | 12/1961 | Feil, Jr. | 248/60 |
| 3,270,992 | 9/1966 | Cassel | 248/60 |
| 3,292,887 | 12/1966 | Cassel et al. | 248/60 |
| 3,983,737 | 10/1976 | Malmgren | 72/377 |
| 4,063,700 | 12/1977 | Brewer | 248/60 |
| 4,116,411 | 9/1978 | Masuda | 248/60 |
| 4,309,019 | 1/1982 | Bloom | 248/610 |

*Primary Examiner*—Ramon O. Ramirez

*Attorney, Agent, or Firm*—Barnes & Thornburg

[57] ABSTRACT

A hanger means having a pair of spaced apart raised portions such that, upon connection of the hanger means with a suspension system isolator means, these raised portions restrict motion of the hanger means relative to the isolator means by being spaced apart by a distance approximately equal to the width of that passageway. These two raised portions are formed by coining one end of the hanger means so as to form, as a first raised portion, a lip and upsetting another portion of the hanger means, spaced apart from that lip, to form an annular collar, as a second raised portion.

6 Claims, 1 Drawing Sheet

FIG. 1
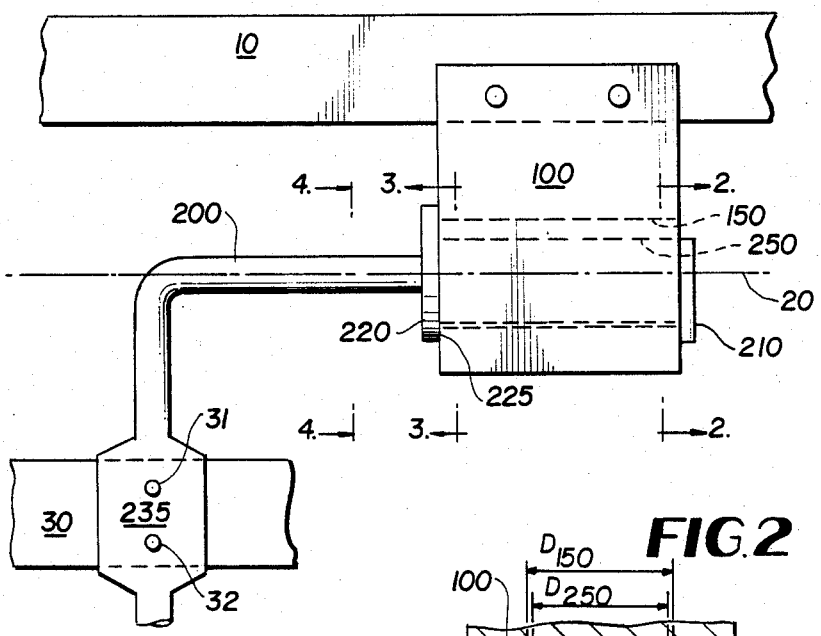
FIG. 2
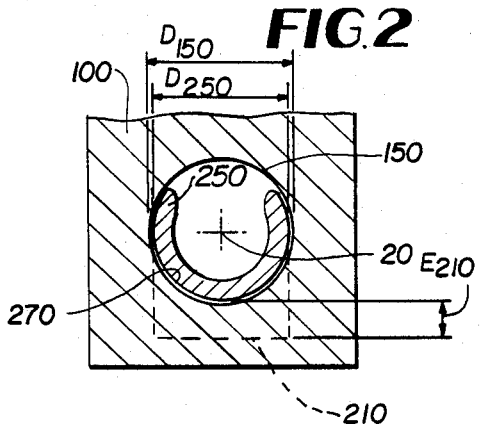
FIG. 3
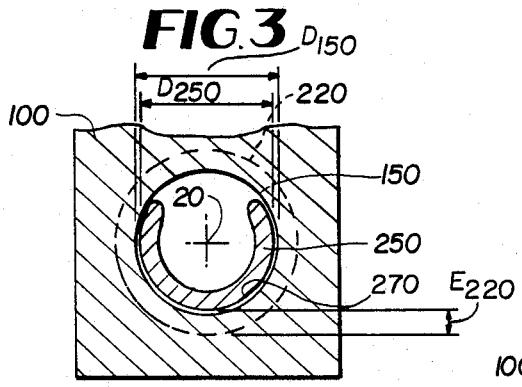
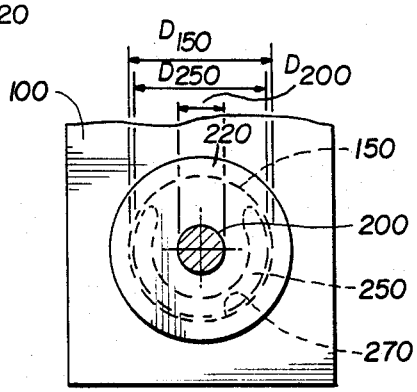
FIG. 4

SUSPENSION SYSTEM HANGER MEANS FORMED BY COLD FORMING PROCESSES

BACKGROUND OF THE INVENTION

The present invention relates generally to suspension systems for vehicular or muffler exhaust systems and processes for producing hanger means for use in such suspension systems.

The muffler and exhaust pipe elements of a vehicular exhaust system have generally been suspended beneath the vehicular frame by suspension devices designed to isolate the vibration and thermal characteristics of these exhaust system elements from the passenger or cargo compartments of the vehicle. Such isolation permitted smooth thermal expansion of the exhaust pipe, by reducing thermal stress, as well as a quieter and pleasanter ride for passengers. Such suspension devices have generally included a hanger means secured to the exhaust system elements, which has a hooked or curved end portion suitable for connection with a flexible isolator means. The isolator means may have had a passageway through a portion of it into which the hooked end of the hanger means could be inserted. The isolator means may have been secured to the vehicular frame directly or secured indirectly through a separate suspension system element.

The hanger means for such suspension systems have been formed in various ways, including welding together two separate stampings of sheet metal or a shaped wire or rod and a single sheet metal stamping. Although these two hanger designs have performed satisfactorily in exhaust suspension systems, they are subject to several problems typically experienced in welded assemblies, including stress corrosion, incomplete welding, and localized softening. Another disadvantage of such hanger means has been that the numerous and time consuming production steps of stamping, assembling, and welding substantially increase hanger cost. Also, welding production processes have often confronted problems removing from the production environment the excess heat generated by welding.

Although various other hanger means have been employed in such suspension systems which have not had all the disadvantages of these welded assemblies, it has been difficult to efficiently produce an inexpensive hanger means which provides for secure connection with the isolator means without substantially increasing the difficulty of insertion and connection, causing excessive wear and tear on the isolator means, or increasing significantly the overall weight of the suspension system and, thus, decreasing vehicle fuel efficiency.

SUMMARY OF THE INVENTION

An object of the invention is to provide a new and improved hanger means for a suspension system.

Another object of the present invention is to provide an inexpensive and efficiently produced hanger means for a suspension system for vehicular muffler or exhaust systems.

A further object of the present invention is to provide an inexpensive and efficiently produced hanger means which may be easily and securely connected with isolator means in a suspension system for vehicular muffler or exhaust systems.

A still further object of the present invention is to provide an inexpensive and efficient hanger means having raised portions thereon formed by cold forming processes.

These and other objects of the present invention are attained by providing a hanger means having a pair of spaced apart raised portions such that, upon connection of the hanger means with a suspension system isolator means, these raised portions restrict motion of the hanger means relative to the isolator means. The hanger means is connected to the isolator means by inserting a portion of the hanger means into and through an isolator means passageway. The raised portions are spaced apart by a distance approximately equal to the width of that passageway. Upon insertion of the hanger means into and through the passageway, the raised portions are adjacent each side of the isolator at the passageway and restrict motion of the hanger means within and along the passageway. These two raised portions are formed by coining one end of the hanger means so as to form a lip, as a first raised portion, and upsetting another portion of the hanger means, spaced apart from that lip, to form an annular collar, as a second raised portion.

Other advantages, an novel features of the present invention will become apparent from the following detailed description of the invention when considered in conjunction with the accompanying drawings.

BRIEF DESCRIPTION OF THE DRAWINGS

FIG. 1 is a plan view of a hanger means incorporating the principles of the present invention connected with an isolator means of a suspension system for a vehicular muffler or exhaust system.

FIG. 2 is a cross-sectional view along line AA of FIG. 1 when viewed from the left side of FIG. 1.

FIG. 3 is a cross-sectional view along line BB of FIG. 1 when viewed from the right side of FIG. 1.

FIG. 4 is a cross-sectional area along line CC of FIG. 1 when viewed from the left side of FIG. 1.

DESCRIPTION OF THE PREFERRED EMBODIMENTS

A preferred embodiment of the present invention, as employed in a suspension system for a vehicular muffler or exhaust system, is illustrated in FIG. 1. Isolator means 100 is shown connected to a portion of the vehicular frame 10 directly by means of bolts or screws 11 and 12, although it is specifically contemplated that one or more other separate suspension system elements, not shown in FIG. 1, may be used to connect isolator means 100 to vehicular frame 10. This connection will generally be made at an exposed portion of the vehicular frame on the underside of the vehicle. Hanger means 200 is shown connected to a vehicular muffler or exhaust system element directly by means of bolts or screws 31 and 32 passing through holes in flattened portion 235 of hanger means 200, although it is specifically contemplated that one or more separate suspension system elements, not shown in FIG. 1, may be used to connect hanger means 200 to vehicular muffler or exhaust system element 30. Also, the orientation of FIG. 1, showing isolator means 100 connected to vehicular frame 10 and hanger means 200 connected to exhaust system element 30 is so illustrated only by way of example. It is specifically contemplated that hanger means 200 may be connected to vehicular frame 10 and isolator means 100 may be connected to exhaust system element 30.

Hanger means 200 has a pair of spaced apart raised portions, hanger lip 210 and hanger collar 220, and a non-raised intermediate length 250, defined between the pair of spaced apart raised portions. Hanger lip 210 and hanger collar 220 have opposing surfaces, hanger lip surface 215 and hanger collar surface 225, respectively.

Isolator means 100 has a passageway 150 through a portion thereof and may be comprised in whole or part of a flexible or elastomeric material suitable to reduce or attenuate vibration transmitted between vehicular frame 10 and exhaust system element 30. In the event that it is not deemed desirable, in a particular embodiment of the subject invention, to construct the entire isolator means 100 of such elastomeric material, at least the portion of isolator means 100 which is adjacent hanger means 200 within passageway 150 should be formed from such elastomeric material. Hanger means 200 is connected to isolator means 100 by the insertion of one end of hanger means 200 into and through passageway 150 within isolator means 100. Hanger lip 210 and hanger collar 220 are separated by a distance approximately equal to the length of passageway 150 such that when hanger means 200 is connected to isolator means 100 these raised portions will be adjacent the sides of passageway 150 so as to restrict motion of hanger means 200 within and along passageway 150. Hanger collar surface 225 will engage the surface of isolator means 100 adjacent the entrance to passageway 150 to prevent further insertion of hanger means 200 into passageway 150. Hanger lip surface 215 will engage the surface of isolator means 100 adjacent the exit from passageway 150 to prevent removal of hanger means 200 from passageway 150. Although only a single hanger collar 220 and hanger lip 210 are shown in FIG. 1, it is specifically contemplated that plural collars and/or lips may be advantageously employed on hanger means 200.

Although not essential to the subject invention, it is particularly advantageous to have the width or diameter, $D_{150}$, of passageway 150 be approximately equal to the width or diameter, $D_{250}$, of non-raised intermediate length 250, as shown in FIGS. 2 and 3. Such an arrangement may provide a more secure connection by reducing the "play" between non-raised intermediate length 250 and the interior surface of passageway 150. This "play" is disadvantageous as it causes wear and tear on isolator means 100 which shortens the useful life of isolator means 100 and the security of the connection with hanger means 200. The elastomeric material from which this portion of isolator means 100 is formed should be sufficiently flexible to permit insertion of hanger lip 210, whose effective width or diameter during the insertion of hanger means 200 in passageway 150 may, depending upon the particular embodiment, be larger than passageway width or diameter $D_{150}$.

It is also specifically contemplated that, to the degree this elastomeric material will withstand continual compression stress, intermediate length width or diameter $D_{250}$ may, in a particular embodiment of the subject invention, exceed passageway width or diameter $D_{150}$, and, thus, assure even more secure connection.

Also, as shown in FIGS. 2 and 3, it is particularly advantageous, although again not essential to the subject invention, to form this non-raised intermediate length 250 of hanger means 200 such that the interior surface of passageway 150 need not be in continuous contact with non-raised intermediate length 250 about the passageway interior circumference. Sufficient support and connection security for hanger means 200 will be provided by the raised portions, hanger collar 220 and hanger lip 210, in conjunction with a non-raised intermediate length 250 having only a few points of contact about the interior circumference of passageway 150 as long at least two of these points of contact are separated by a distance approximately equal to passageway width or diameter $D_{150}$. Since non-raised intermediate length 250 does not have to completely fill passageway 150, significant savings may be realized in production of hanger means 200 as less material need be used. If less material is used in the production of hanger means 200, the weight of hanger means 200 and the overall weight of the vehicle may be decreased and, thus, vehicle fuel efficiency may be improved.

Hanger means 200 may be formed from one or more pieces of any sufficiently rigid material, but it is particularly advantageous to form it from a single piece of wire or rod material. When using a single piece of wire or rod material, the raised portions, hanger collar 220 and hanger lip 210, of hanger means 200 may be formed by cold forming processes which include the steps of coining one end of hanger means 200 to form hanger lip 210 and, at a location appropriately spaced from hanger lip 210, upsetting a portion of hanger means 200 so as to form an annular collar, hanger collar 220, about hanger means 200. As mentioned above, the finished raised portions should be separated by a distance approximately equal to the length of passageway 150. The coining step may be performed by a single press stroke of a coining press creating a lip which projects beyond the edge of non-raised intermediate length 250 by a distance or height $E_{210}$, as shown in FIG. 3. The use of these two cold forming steps, coining and upsetting, together permits the formation of raised portions of sufficient extension height, $E_{210}$ and $E_{220}$, so as to restrict motion of hanger means 200 relative to isolator means 100 in both directions along passageway 150. Thus, the connection is made secure by the "locking" of these raised portions with isolator means 100.

If wire or rod material of uniform width or diameter, $D_{200}$, is used in forming hanger means 200, it is particularly advantageous, although not essential to the subject invention, to change width or diameter $D_{200}$ of hanger means 200 in non-raised intermediate length 250 to an increased width or diameter, $D_{250}$, during the coining step. The coining press may perform both these changes on the wire or rod with a single press stroke. Increased width or diameter $D_{250}$ of non-raised intermediate length 250 may be obtained by coining non-raised intermediate length 250 into a curved form whose radial cross-section is not completely filled with a solid material from central longitudinal axis 20 to outer surface 270, as seen in FIGS. 2, 3, and 4. When coining non-raised intermediate length 250 it is also advantageous to form this area with as few sharp edges or rough surfaces as possible so as to reduce wear and tear on the elastomeric material of the interior surface of passageway 150 Increasing width or diameter $D_{200}$ of hanger means 200 by cold forming permits thinner wire or rod material to be used in the production of hanger means 200, thus reducing production costs and vehicle weight.

It is also advantageous, although again not essential to the subject invention to form hanger lip 210 such that the lip projects beyond the width or diameter of non-raised intermediate length 250 over no greater than three-fourths of the circumference of non-raised intermediate length 250. This projection circumferential distance is shown in FIG. 2 as the arc XYZ. In fact, hanger lip 210, in conjunction with hanger collar 220, need only project outward from a relatively small portion of that circumference in order to successfully restrict motion between hanger means 200 and isolator means 100. Although the security of the connection, or the "locking", is a function of both extension distances or heights $E_{210}$ and $E_{220}$ and the projection circumferential distances of the raised portions, hanger lip 210 must be inserted through passageway 150 to complete the connection. If the projection circumferential distance of hanger lip 210 exceeds three-fourths of the circumference of non-raised intermediate length 250, insertion of hanger lip 210 may become difficult, especially if width or diameter $D_{150}$ of passageway 150 is approximately equal to width or diameter $D_{250}$ of non-raised intermediate length 250 and if the extension distance or height $E_{210}$ is necessarily large. A smaller projection circumferential diameter for hanger lip 210 may make this insertion easier. If this projection circumferential diameter is reduced to a minimum, extension distance or height $E_{210}$ may be made sufficiently large so as to assure secure connection and motion restriction between hanger means 200 and isolator means 100. Since hanger collar 220 is not to be inserted into passageway 150, it is not subject to any projection circumferential distance restrictions and may advantageously project about the complete circumference on non-raised intermediate length 250.

Finally, it should be noted that, although the raised portions shown in FIG. 1 project perpendicularly from the central longitudinal axis 20 of hanger means 200, it is specifically contemplated that surfaces 215 and 225 may be inclined with respect to this axis. Also, extension distances or heights $E_{210}$ and $E_{220}$ need not be constant about the circumference of their respective raised portions.

From the preceding description of the preferred embodiments, it is evident that the objects of the present invention are attained in that a new hanger means for a suspension system is provided which has a pair of spaced apart raised portions formed by cold forming processes. Although the invention has been described and illustrated in detail, it is clearly understood that the same is by way of illustration and example only and is not to be taken by way of limitation. The spirit and scope of the present invention are to be limited only by the terms of the appended claims.

What is claimed is:

1. In a suspension system, for suspending a vehicular muffler or exhaust system element underneath a vehicular frame, having a hanger means an isolator means having opposing sides, formed with a passageway therethrough and adapted to be connected to said hanger means by insertion of a length of said hanger means into said passageway, and having said hanger means and said isolator means connected between the vehicular muffler or exhaust system element and the vehicular frame, the improvement comprising a pair of raised portions on that length of said hanger means adjacent to and inserted into said passageway, said raised portions being separated by an intermediate portion having a length approximately equal to the length of said passageway such that, upon insertion of said hanger means into and through said passageway, said raised portions are adjacent and substantially in contact with said opposing sides of said isolator means at said passageway so as to restrict motion of said hanger means within and along said passageway in either direction by engaging the exterior of said isolator means, said passageway being surrounded by flexible material and the width or diameter of the passageway opening being approximately equal to the width or diameter of the intermediate portion of said hanger means which may be inserted in said passageway.

2. The suspension system of claim 1, wherein said intermediate portion has a width or diameter greater than the width or diameter of those portions of said passageway opening when said hanger means is not inserted therein, and said hanger means includes an integral, flattened means adapted to be secured directly to said vehicular muffler element.

3. In a suspension system, for suspending a vehicular muffler or exhaust system element underneath a vehicular frame, having a hanger means and an isolator means having opposing sides, formed with a passageway therethrough and adapted to be connected to said hanger means by insertion of a length of said hanger means into said passageway, and having said hanger means and said isolator means connected between the vehicular muffler or exhaust system element and the vehicular frame, the improvement comprising a pair of raised portions on that length of said hanger means adjacent to and inserted into said passageway, said raised portions being separated by an intermediate portion having length approximately equal to the length of said passageway such that, upon insertion of said hanger means into and through said passageway, said raised portions are adjacent and substantially in contact with said opposing sides of said isolator means at said passageway so as to restrict motion of said hanger means within and along said passageway in either direction by engaging the exterior of said isolator means, said isolator means being comprised of an elastomeric material, said hanger means being formed from a single piece of rod or wire material, and said intermediate portion having a width or diameter greater than the width or diameter of those portions of said hanger means excluding said raised portions.

4. The suspension of claim 3, wherein said intermediate portion has a cross-section such that it is not in continuous contact, about an interior circumference of the passageway, with said passageway when said intermediate portion is inserted into said passageway.

5. In a suspension system, for suspending a vehicular muffler or exhaust system element underneath a vehicular frame, having a hanger means and an isolator means having opposing sides, formed with a passageway therethrough and adapted to be connected to said hanger means by insertion of a length of said hanger means into said passageway, and having said hanger means and said isolator means connected between the vehicular muffler or exhaust system element and the vehicular frame, the improvement comprising a pair of raised portions including at least a first lip and at least one collar on that length of said hanger means adjacent to and inserted into said passageway, said raised portions being separated by an intermediate portion having a length approximately equal to the length of said passageway such that, upon insertion of said anger means into and through said passageway, said raised portions are adjacent and substantially in contact with said opposing sides of said isolator means at said passageway so as to restrict motion of said hanger means within and along said passageway in either direction by engaging the exterior of said isolator means, said lip projecting beyond the width or diameter of the intermediate portion of said hanger means over not greater than three-fourths of a circumference of said intermediate portion and said collar projecting beyond the width or diameter of said intermediate portion over the entire circumference of said intermediate portion.

6. In a suspension system, for suspending a vehicular muffler or exhaust system element underneath a vehicular frame, having a hanger means an isolator means having opposing sides, formed with a passageway therethrough and adapted to be connected to said hanger means by insertion of a length of said hanger means into said passageway, and having said hanger means and said isolator means connected between the vehicular muffler or exhaust system element and the vehicular frame, the improvement comprising a pair of raised portions on that length of said hanger means adjacent to and inserted into said passageway, said raised portions being separated by a distance approximately equal to the length of said passageway such that, upon insertion of said hanger means into and through said passageway, said raised portions are adjacent and substantially in contact with said opposing sides of said isolator means at said passageway so as to restrict motion of said hanger means within and along said passageway in either direction by engaging the exterior of said isolator means, said pair of raised portions being comprised of at least one front lip and at least one rear collar having opposing surfaces for engaging respectively opposing exterior sides of said isolator means, and said hanger means including an integral flattened portion, displaced from said raised portions, that is adapted to be secured to a vehicular muffler element.

* * * * *